US007814941B2

(12) United States Patent
Alex et al.

(10) Patent No.: US 7,814,941 B2
(45) Date of Patent: Oct. 19, 2010

(54) FLUID TRANSFER APPARATUS

(75) Inventors: Peter Alex, Cloverville (CA); Johnny Laureijs, Stellarton (CA); Ronald R. Chisholm, Truro (CA)

(73) Assignee: Scepter Corporation (CA)

( * ) Notice: Subject to any disclaimer, the term of this patent is extended or adjusted under 35 U.S.C. 154(b) by 836 days.

(21) Appl. No.: 10/549,786

(22) PCT Filed: Mar. 19, 2003

(86) PCT No.: PCT/CA03/00364

§ 371 (c)(1),
(2), (4) Date: Jun. 13, 2006

(87) PCT Pub. No.: WO2004/083103

PCT Pub. Date: Sep. 30, 2004

(65) Prior Publication Data

US 2006/0237089 A1 Oct. 26, 2006

(51) Int. Cl.
*B65B 1/04* (2006.01)
*B67D 3/00* (2006.01)

(52) U.S. Cl. ..... 141/26; 141/21; 141/25; 141/67; 222/505

(58) Field of Classification Search ..... 141/21–29, 141/67, 98, 206, 325, 326, 387, 392; 222/401, 222/402, 397, 382, 464.1, 464.7, 377, 530, 222/538, 561, 505, 189.1
See application file for complete search history.

(56) References Cited

U.S. PATENT DOCUMENTS 2,066,977 A 1/1937 Iler
4,022,347 A * 5/1977 Noble ..... 222/1
4,709,859 A 12/1987 Schulze et al.

(Continued)

FOREIGN PATENT DOCUMENTS

DE 54 890 1/1891

(Continued)

OTHER PUBLICATIONS

Office Action mailed Mar. 29, 2007 for U.S. Appl. No. 10/851.668 filed May 24, 2004 (now issued U.S. Patent No. 7,422,039 issued Sep. 9, 2008).

(Continued)

*Primary Examiner*—Timothy L Maust
(74) *Attorney, Agent, or Firm*—McCormick, Paulding & Huber LLP

(57) ABSTRACT

A fluid transfer system includes a fluid container to receive a liquid and an apparatus for pressurizing liquid in the container including a deformable envelope defining a space for receiving a gas. Deformation of the envelope contracts the space to a contracted condition such that, when the space includes the gas, deformation of the envelope contracts the space to effect a transfer of a portion of the gas to the container to effect pressurization of the liquid in the container. A dispensing nozzle includes a fluid passage having a nozzle inlet and outlet, and an orifice defined by a valve seat. The nozzle inlet is in fluid communication with the container for effecting a discharge of the liquid from the container. A sealing member is biased into sealing engagement with the valve seat for sealing fluid communication between the nozzle inlet and the nozzle outlet.

10 Claims, 4 Drawing Sheets

U.S. PATENT DOCUMENTS

| | | | | |
|---|---|---|---|---|
| 4,972,972 | A * | 11/1990 | Goguen | 222/130 |
| 5,176,327 | A | 1/1993 | Petersen et al. | |
| 5,244,021 | A * | 9/1993 | Hau | 141/285 |
| 6,068,163 | A * | 5/2000 | Kihm | 222/189.1 |
| 6,412,528 | B1 * | 7/2002 | Alex et al. | 141/323 |
| 6,659,373 | B1 | 12/2003 | Heren et al. | |
| 7,422,039 | B2 * | 9/2008 | Chisholm et al. | 141/323 |

FOREIGN PATENT DOCUMENTS

| | | |
|---|---|---|
| DE | 873 661 | 4/1953 |

OTHER PUBLICATIONS

Final Office Action mailed Nov. 6, 2007 for U.S. Appl. No. 10/851,668 filed May 24, 2004 (now U.S. Patent No. 7,422,039 issued Sep. 9, 2008).

Advisory Action mailed Dec. 7, 2007 for U.S. Appl. No. 10/851,668 filed May 24, 2004 (now U.S. Patent No. 7,422,039 issued Sep. 9, 2008).

* cited by examiner

FLUID TRANSFER APPARATUS

CROSS-REFERENCE TO RELATED APPLICATIONS

This application is entitled to the benefit of International Application No. PCT/CA2003/000389, filed on Mar. 19, 2003.

FIELD OF THE INVENTION

This invention relates generally to transferring a liquid from one container to another container. In particular, it relates to a system for a fluid transfer system having means for improved operator control.

BACKGROUND OF THE INVENTION

Liquids must often be transferred between a storage container and a temporary storage receptacle before the liquid is processed in a subsequent downstream operation. Such a temporary storage receptacle may be a gas tank on an automobile, snow mobile, or a lawnmower. Known systems for effecting transfer of liquid between such containers suffer from various disadvantages. For instance, existing fluid transfer systems are susceptible to spillage, or are difficult to control.

SUMMARY OF THE INVENTION

The present invention provides a fluid transfer system comprising:

a fluid container configured to receive a liquid;

means for pressurizing the liquid in the container, comprising a deformable envelope defining a space for receiving a gas, a deformation of the envelope effecting a contraction of the space to a contracted condition, such that, when the space includes the gas, the deformation of the envelope results in the contraction of the space to effect a transfer of at least a portion of the gas to the container to thereby effect pressurization of the liquid in the container;

a dispensing nozzle including:

a fluid passage having a nozzle inlet, a nozzle outlet, and an orifice for effecting fluid communication between the nozzle inlet and the nozzle outlet, the orifice being defined by a valve seat, the nozzle inlet fluidly communicating with the container for effecting a discharge of the liquid from the container;

a sealing member biased into sealing engagement with the valve seat for sealing fluid communication between the nozzle inlet and the nozzle outlet; and a manually operated actuator for effecting displacement of the sealing member from the valve seat to effect fluid communication between the nozzle inlet and the nozzle outlet.

In one aspect, the discharge of the liquid from the container is effected when the sealing member is displaced from the valve seat.

In another aspect, the pressurization is effected while the sealing member is sealingly engaged to the valve seat.

In a further aspect, the means for pressurizing the liquid in the container includes a first valve means being biased by a first biasing force to assume a normally closed condition, whereby fluid communication between the space and the container is sealed, the first valve means being configured to assume an open condition, whereby fluid communication is effected between the space and the container to effect the transfer of the at least a portion of the gas from the space to the container, when the contraction of the space effects a fluid pressure differential force between the space and the container to overcome the biasing force.

In yet another aspect, the deformable envelope is resilient.

In another aspect, the means for pressurizing includes:

an inlet configured to effect supply of the gas to the space; and a second valve means being biased by a second biasing force to assume a normally closed condition, whereby fluid communication between the space and the inlet is sealed, the second valve means being configured to assume an open condition, whereby fluid communication is effected between the inlet and the space to effect a transfer of at least a second portion of the gas from the inlet to the space, when the expansion of the space from the contracted condition effects a fluid pressure differential force between the inlet and the space to overcome the second biasing force.

In a further aspect, each of the first valve means and the second valve means is a non-return valve or, more particularly, a flapper valve.

In another aspect, the discharge of the liquid from the container is effected by a fluid pressure differential between the container and the nozzle outlet.

In yet another aspect, the container includes a container inlet and a container outlet, the container inlet fluidly communicating with the means for pressurizing via a first conduit, the container outlet fluidly communicating with the nozzle inlet via a second conduit. Each of the first and second conduits can include a flexible hose.

In a further aspect, the container includes a vent.

DETAILED DESCRIPTION

Figure 1:
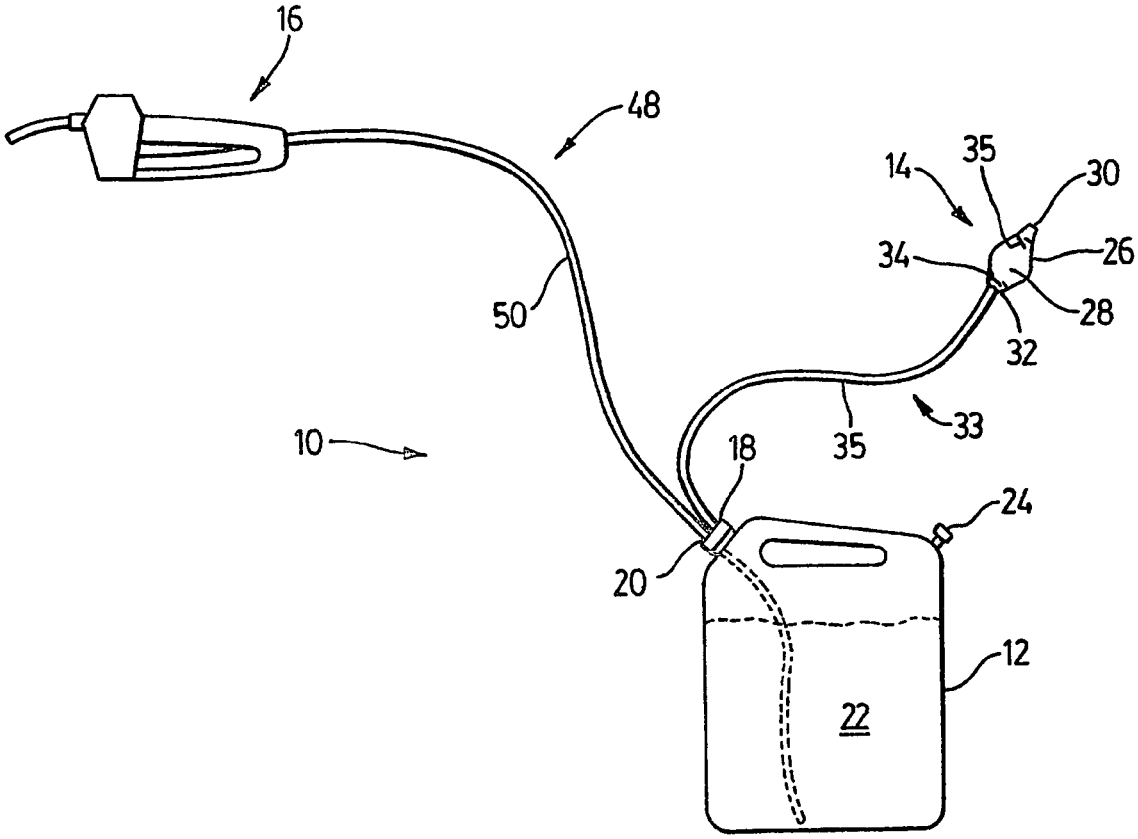
FIG. 1 is a schematic illustration of a first embodiment of the system of the present invention.

Referring to FIG. 1, the present invention provides a fluid transfer system 10 for effecting fluid transfer between a first fluid container 12 and a second fluid container (not shown).

The fluid transfer system 10 comprises a fluid container 12 configured to receive a liquid, a means for pressurizing 14 the liquid in the container 12, and a dispensing nozzle 16 for discharging and controlling the discharge of the liquid from the container 12.

The fluid container 12 includes an inlet 18, an outlet 20, and defines a storage volume 22. The inlet 18 is configured to effect fluid communication between the pressurizing means 14 and the storage volume 22. The outlet 20 is configured to effect fluid communication between the dispensing nozzle 16 and the storage volume 22. The fluid container 12 also includes a vent 24 for periodically venting the container 12 to atmosphere.

The pressurizing means 14 comprises a deformable, resilient envelope 26 defining a space 28 for receiving a gas. The pressurizing means 14 includes an inlet 30 and an outlet 32. The inlet 30 is configured to effect transfer of gas from outside the envelope 26 to the space 28. The outlet 32 is configured to effect transfer of fluid from the space 28 to the container 12. The outlet 32 communicates with the storage volume 22 via conduit 33. Conduit 33 includes a flexible hose 35.

Deformation of the envelope 26 is configured to effect a contraction of the space 28 to a contracted condition. When the space 28 includes a gas, the deformation of the envelope 26, with resultant contraction of the space 28, effects a transfer of at least a first portion of the gas from the space 28 to the container 12. As a result of this transfer of gas, liquid in the container 12 becomes pressurized.

In the embodiment illustrated, the pressurizing means 14 comprises a squeezable bulb (or hand pump). Alternatively, the pressurizing means comprises a foot pump.

To ensure that this transfer of gas effects pressurization of the liquid in the container 12, the pressurizing means 14 includes a first valve means 34 which functions as a non-return valve so that the gas transferred from the space 28 to the container 12 during the contraction does not return to the space 28 once the space 28 begins to expand (i.e., once the force effecting the contraction is removed). The first valve means 34 permits flow of gas from within the space 28 to the container 12, but prevents return flow of any gas from the container 12 to the space 28. The first valve means 34 is configured such that it is biased by a first biasing force to a normally closed condition, whereby fluid communication between the space 28 and the container 12 is sealed. The first valve means 34 can assume an open position, whereby fluid communication is effected between the space 28 and the container 12 to effect the transfer of at least a portion of the gas from the space 28 to the container 12, when the contraction of the space 28 effects a fluid pressure differential force between the space 28 and the container 12 sufficient to overcome the biasing force. Upon expansion of the envelope 26 from a contracted state, the first valve means 34 prevents transfer of fluid from the container 12 to the space 28. In one embodiment, the first valve 34 means is a flapper valve.

The pressurizing means 14 further includes a second valve means 35, which also functions as a non-return valve, to prevent discharge of gas from the space 28 and through the inlet 30 as the space 28 is contracted, but permits flow of gas into the space 28 from the inlet 30 during expansion of the space 28 from the contracted state (to refill the space 28 with gas). The second valve means 35 is biased by a second biasing force to assume a normally closed condition, whereby fluid communication between the space 28 and the inlet 30 is sealed., The second valve means 35 is configured to assume an open condition, whereby fluid communication is effected between the inlet 30 and the space 28 to effect a transfer of at least a portion of the gas from the inlet 30 to the space 28. Such an open condition is assumed when the expansion of the space 28 from the contracted condition effects a fluid pressure differential force between the inlet 30 and the space 28 sufficient to overcome the second biasing force. Once the fluid pressure equalizes between the space 28 and the inlet 30, the biasing force effects return of the second valve means 35 to the closed condition. In one embodiment, the second valve means 35 is a flapper valve.

The storage volume in the container 12 is pressurized by the gas transferred from the pressurizing means 14. With the dispensing nozzle 16 in a condition preventing liquid flow out of the container 12 (as further described below), the storage volume 22 can be gradually pressurized by the pressurizing means 14 to a desired pressure. The pressure imparted to the liquid in the storage volume 22 acts as the driving force to facilitate discharge of the liquid from the storage container out through the nozzle 16 (as further described below).

Figure 2:
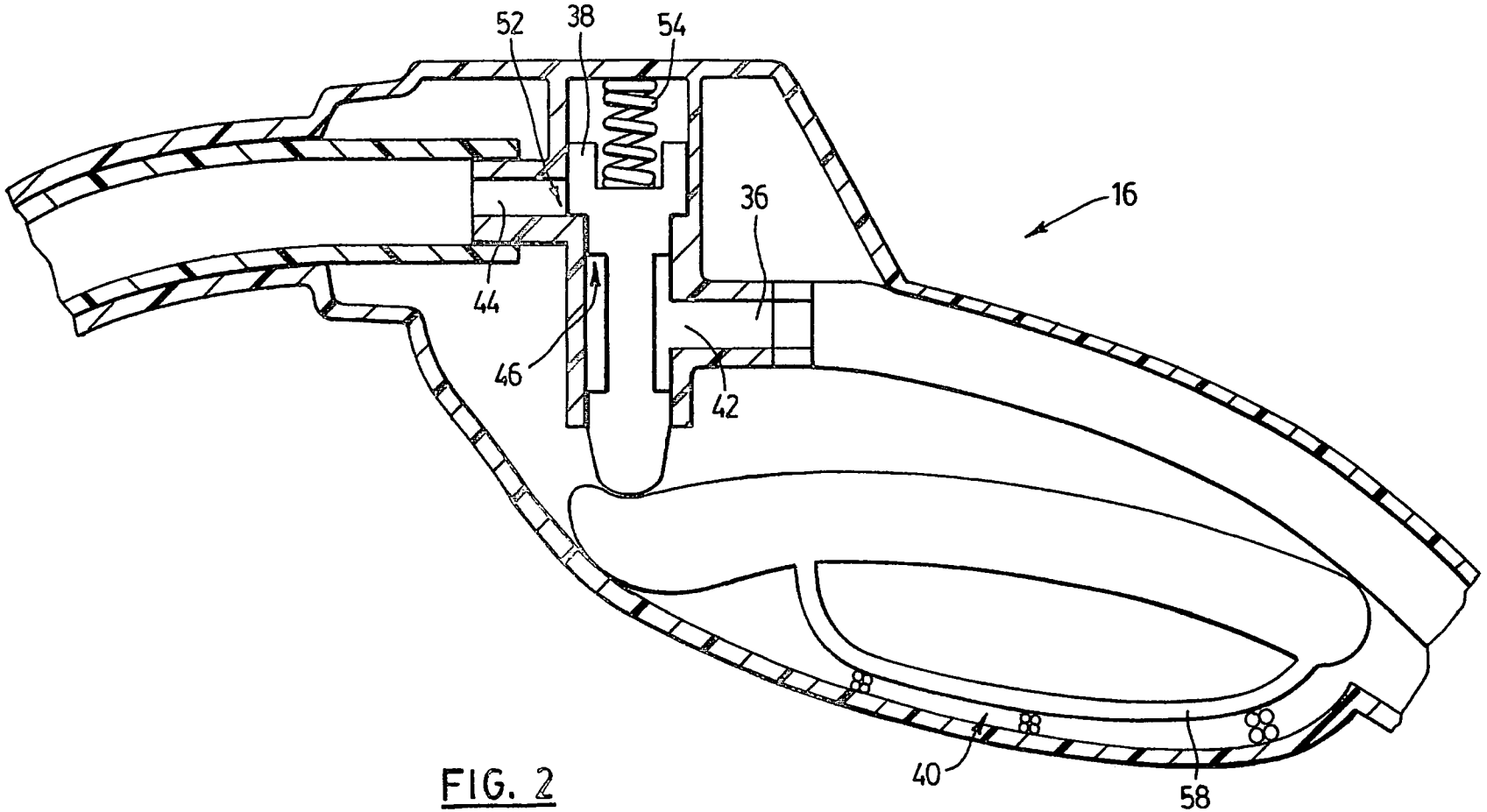
FIG. 2 is a detailed schematic illustration of a dispensing nozzle of the system illustrated in FIG. 1.

Referring to FIG. 2, the dispensing nozzle 16 includes a fluid passage 36 for effecting discharge of the liquid from within the container 12, a sealing member 38 configured for controlling or preventing discharge of liquid from within the container 12, and a manually operated actuator 40 for effecting manual control of the sealing member 28.

The fluid passage 36 has a nozzle inlet 42, a nozzle outlet 44, and an orifice 46 for effecting fluid communication between the nozzle inlet 42 and nozzle outlet 44. The nozzle inlet 42 fluidly communicates with the container 12 for effecting a discharge of the liquid from the container 12. In this respect, the nozzle inlet 42 is fluidly coupled to the container outlet 20 by a conduit 48. The conduit 48 includes a flexible hose 50 for flexible positioning of the dispensing nozzle 16 vis-à-vis the container 12.

The orifice 46 is defined by a valve seat 52. The sealing member 38 is biased into sealing engagement with the valve seat 52 for sealing fluid communication between the nozzle inlet 42 and the nozzle outlet 44, and thereby controlling or preventing the discharge of the liquid from within the container 12. In one embodiment, the sealing member 38 is biased by a resilient member 54, such as a compression spring.

The manually operated actuator 40 is provided for effecting displacement of the sealing member 38 from the valve seat 52 to effect fluid communication between the nozzle inlet 42 and the nozzle outlet 44. In one embodiment, the manually operated actuator 40 comprises a hand lever 58 pivotally coupled to the dispensing nozzle 16. The hand lever 58 is configured to effect movement of the sealing member 38 into and out of sealing engagement with the valve seat 52. Pressing on the hand lever 58 results in displacement of the sealing member 38 from the valve seat 52, thereby effecting fluid communication between the nozzle inlet 42 and the nozzle outlet 44. Upon removal of this force from the hand lever 58, the resilient member 54 urges the sealing member 38 to return into sealing engagement with the valve seat 52, thereby sealing fluid communication between the nozzle inlet 42 and the nozzle outlet 44, and thereby preventing discharge of liquid from within the container 12.

In the static condition, liquid is disposed in the container 12, and the sealing member 38 effects sealing of communication between the container 12 and the nozzle outlet 44. In effect, discharge of the liquid in the container 12 through the nozzle outlet 44 is prevented.

To effect pressurization of the liquid in the container 12, the envelope is cyclically contracted and expanded until a desired fluid pressure is reached in the container 12. At this point, the hand lever 58 is pressed to effect displacement of the sealing member 38 from the valve seat 52 and thereby effect fluid communication between the container 12 and the nozzle outlet 44. Typically, the nozzle outlet 44 is positioned over a receiving container, such as a gas tank in a car or a lawnmower. As such, the pressure at the nozzle outlet 44 is atmospheric. Because the liquid in the container 12 is pressurized, a pressure differential exists between the container 12 and the nozzle outlet 44, thereby effecting liquid flow from the container 12 to the nozzle outlet 44. To terminate liquid flow, the force acting on the hand lever 58 is removed, and the sealing member 38 returns to sealing engagement with the valve seat 52, thereby preventing flow between the container 12 and the nozzle outlet 44.

Figure 3:
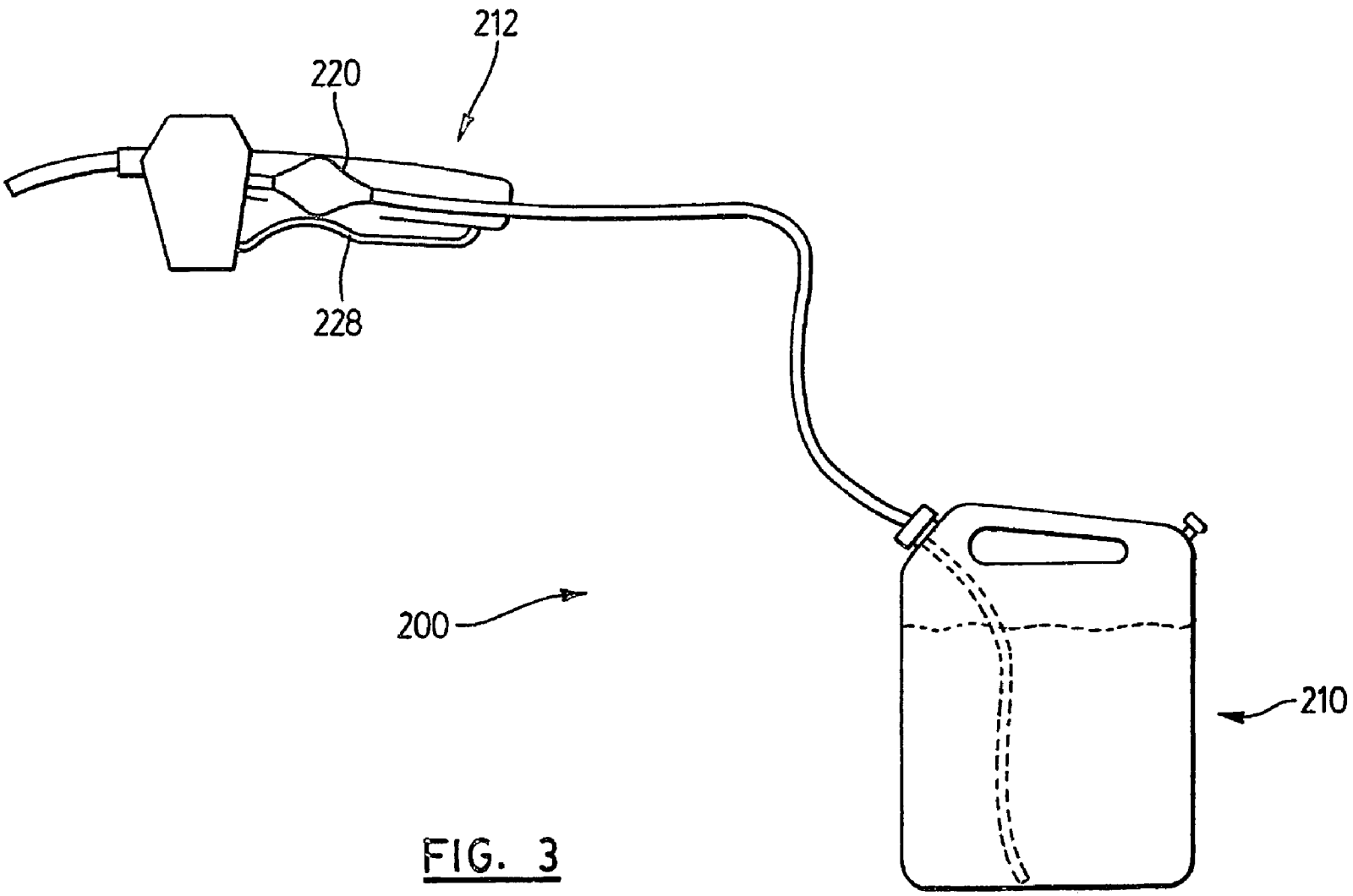
FIG. 3 is a schematic illustration of a second embodiment of the system of the present invention.

FIG. 3 illustrates a second embodiment of a system 200 of the present invention. The second embodiment includes a fluid container 210 configured for receiving and storing a liquid, and a dispensing apparatus 212 for effecting discharge of the liquid from the container 210. The liquid in the container 210 fluidly communicates with the dispensing apparatus 212.

The dispensing apparatus 212 includes a fluid passage 214 having a nozzle inlet 216, and a nozzle outlet 218, and an orifice 219. The nozzle inlet 216 fluidly communicates with the container. The nozzle outlet 218 communicates with atmospheric pressure, and is configured for insertion to a second container (not shown) to effect transfer of liquid from the first container 210 to the second container. The orifice 219 effects fluid communication between the nozzle inlet 216 and the nozzle outlet 218, and is defined by a valve seat 221. A fluid flow actuator 225 is provided to actuate flow of fluid from the container 210 and through the dispensing apparatus 212.

A sealing member 223 is provided and configured to control or prevent flow of fluid between the nozzle inlet 216 and the nozzle outlet 218. In this respect, the sealing member 223 is biased into sealing engagement with the valve seat 221 to seal fluid communication between the nozzle inlet 216 and the nozzle outlet 218. In one embodiment, the sealing member 223 is biased by a resilient member 227, such as compression spring.

The fluid flow actuator 225 comprises a deformable envelope 220 defining a space 272 for receiving a gas. Deformation of the envelope 220 effects a contraction of the space 272 to a contracted condition. When the space 222 includes a gas, the deformation of the envelope 220 results in the contraction of the space 222 to effect a discharge of at least a portion of the gas from the space 222 and to the nozzle outlet 218. This effects evacuation of at least a portion of the gas from the space 222 and creates a vacuum condition within the space 222 relative to the container.

To prevent a return of the exhausted gas to the space 222 of the envelope 220, a first valve means 224 is provided to function as a non-return valve. The first valve means 224 is biased by a first biasing force to assume a normally closed condition, whereby fluid communication between the space 222 and the nozzle outlet 218 is sealed. The first valve means 224 is configured to assume an open condition, whereby fluid communication is effected between the space 222 and the nozzle outlet 218 to effect the discharge of at least a portion of the gas from the space 222 and out through the nozzle outlet 218. This condition is assumed when the contraction of the space effects a fluid pressure differential force between the space 222 and the nozzle outlet 218 acting on the first valve means 224 sufficient to overcome the biasing force. Upon expansion of the space 222 from the contracted condition, the valve means 224 is forced to close by virtue of the reduction in the fluid pressure differential, as well as the biasing force. In the embodiment shown, the first valve means 224 is a flapper valve.

The fluid flow actuator further 225 includes a second valve means 226, also functioning as a non-return valve, for preventing back flow of gas from the space 222 to the container 210. The second valve means 226 is biased by a biasing force to assume a normally closed condition, whereby fluid communication between the space 222 and the container 210 is sealed. The second valve means 226 is configured to assume an open condition, whereby fluid communication is effected between the inlet 216 and the space 222 to effect a transfer of fluid (gas and/or liquid) from the inlet 216 to the space 222. This condition is assumed when the expansion of the space 222 from the contracted condition effects a fluid pressure differential force between the inlet 216 and the space 222 acting on the valve means 226 sufficient to overcome the second biasing force. Once the fluid pressure in the space 222 equalizes with the fluid pressure at the inlet 216, the biasing force effects return of the second valve means 226 into the closed condition, thereby sealing fluid communication between the space 222 and the container 210. In the embodiment shown, the second valve means 226 is a flapper valve.

Figure 4:
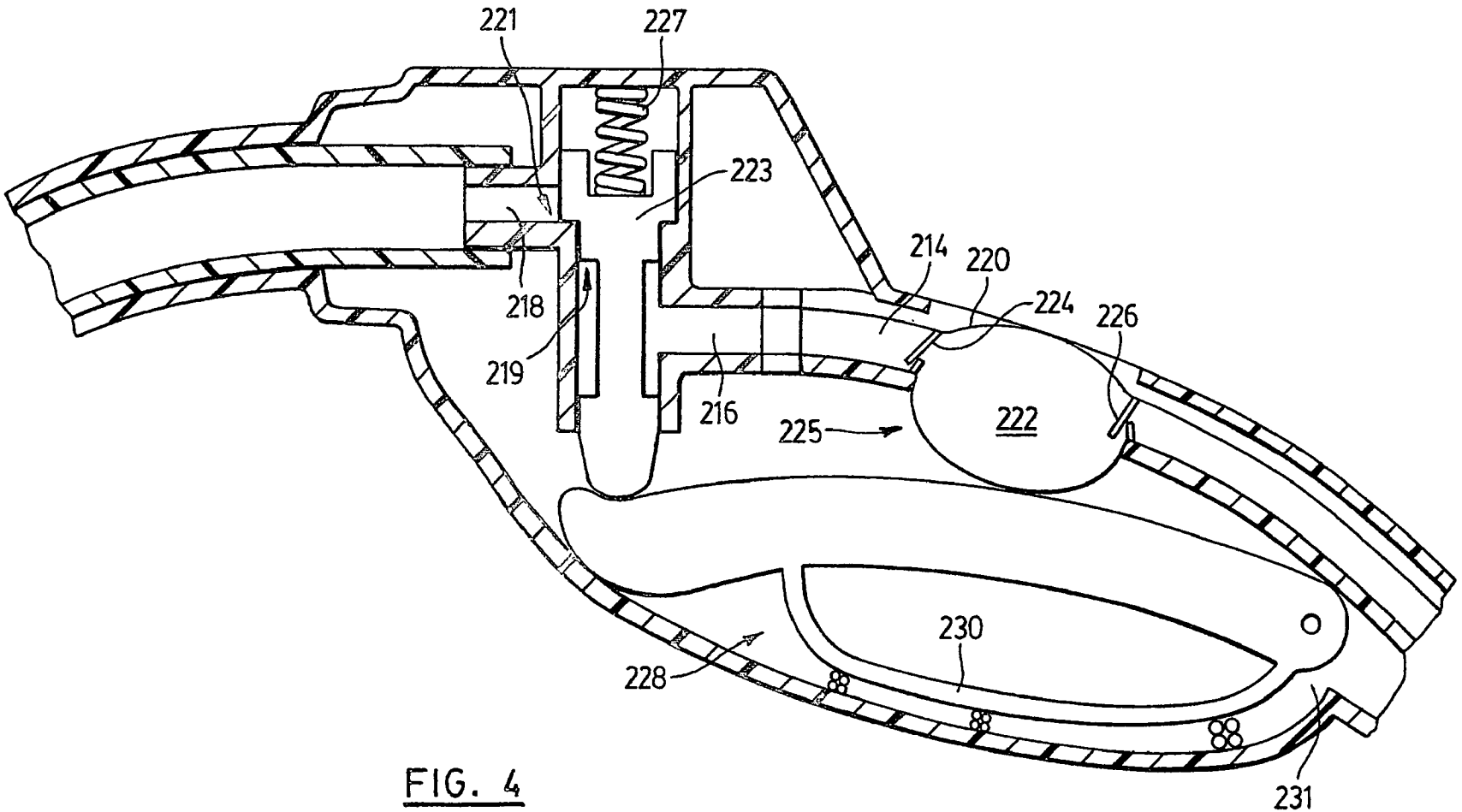
FIG. 4 is a detailed schematic illustration of a dispensing nozzle of the system illustrated in FIG. 2.

To effect contraction and expansion of the space 222, the deformable envelope 220 is coupled to a manual actuator 228. As shown, the manual actuator 228 comprises a hand lever 230. Referring to FIG. 4, the hand lever 230 is pivotally coupled to a frame 231 of the dispensing apparatus 212. Pressing on the hand lever 230 results in the deformation of the envelope 220 and consequent contraction of the space 222. Releasing the lever 230, when the space 222 is in the contracted condition, results in expansion of the space 222 and its return to an original expanded condition.

The hand lever 230 is further coupled to the sealing member 223 for controlling or preventing fluid flow between the nozzle inlet 214 and the nozzle outlet 216. Pressing on the hand lever 230 effects displacement of the sealing member 223 from the valve seat to effect fluid communication between the nozzle inlet 214 and the nozzle outlet 216. This phenomenon is in concert with the contraction of the space 222. Release of the hand lever 230 permits the resilient member 227 to urge the sealing member 223 to return to sealing engagement with the valve seat 221, thereby sealing fluid communication between the nozzle inlet 214 and the nozzle outlet 218.

The system 200 is useful for effecting siphoning of liquid from container 210 where the level of the liquid is elevated relative to the discharge of the dispensing apparatus 210. To effect flow of liquid from the container 210, and its eventual discharge through nozzle outlet 218, hand lever 230 is pressed. Pressing of hand lever 230 causes pivotal rotation of the hand lever 230 so that hand lever 230 comes into contact with and presses against the envelope 220 of the flow actuator 225. As the hand lever 230 presses against the envelope 220, the envelope 220 deforms, with consequent contraction of the space 222. Upon contraction of the space 222, fluid within the space 222 becomes pressurized. This fluid pressure eventually overcomes the biasing force being applied to the valve means 224, and effects opening of valve means 224. such that fluid communication is effected between the space 222 and the nozzle outlet 218, and fluid flows from the space 222 and discharges from the nozzle 218, thereby effecting evacuation of the space 222.

Eventually, the fluid pressure within the space 222 subsides such that the valve means 224 returns to a closed position, sealing fluid communication between the space 222 and the nozzle outlet 218. In parallel, the evacuation of the space 222 results in a reduced fluid pressure within the space 222 such that a vacuum condition is created in the space 222 relative to the container 210. This vacuum condition forces open the valve means 226, and provides a driving force to effect flow of fluid (liquid and/or gas) from the container 210. The priming action of effecting alternating contraction/expansion of the space 222 eventually results in the fluid passage being occupied by liquid from the container 210. When this happens, a siphoning process is established, and liquid flow will continue so long as the liquid level in the container 210 is elevated relative to the discharge of the dispensing apparatus 212. The rate of liquid flow during siphoning may be controlled by the hand lever. If desired, the siphoning process can be stopped by sufficiently pressing on the hand lever to cause sealing engagement of the valve member 223 with the valve seat 221.

It will be understood, of course, that modifications can be made to the embodiments of the invention described herein without departing from the scope and purview of the invention as defined by the appended claims.

We claim:

1. A dispensing apparatus configurable in fluid communication with a supply container for dispensing a fluid therefrom, said dispensing apparatus comprising:

a. a fluid passage comprising:

i. an inlet;

ii. an outlet; and iii. an orifice configurable to provide fluid communication between said inlet and said outlet;

b. a deformable envelope defining a space, configurable to receive said fluid from said supply container by action of a pressure differential between said supply container and said space, and operatively associated with said inlet for fluid flow thereto; and c. a sealing member laterally separated from said deformable envelope, biased to a closed position that prevents a flow between said inlet and said outlet, and movable to allow said flow in an open position.

2. The dispensing apparatus of claim 1, wherein movement of said sealing member and deformation of said envelope is achieved using an actuating means.

3. The dispensing apparatus of claim 2, wherein said actuating means is configured to move said sealing member to said open position and to contract said space, in concert.

4. The dispensing apparatus of claim 1, wherein said orifice is defined by a valve seat, and said sealing member is biased into a sealing engagement with said valve seat in said closed position.

5. The dispensing apparatus of claim 2, wherein said pressure differential between said supply container and said space occurs by a reduction in pressure within said space relative to said supply container, created by a contraction and a subsequent expansion of said space using said actuating means.

6. The dispensing apparatus of claim 1, wherein said envelope is resilient.

7. The dispensing apparatus of claim 1, wherein said space is operatively coupled to said supply container by a flexible hose.

8. The dispensing apparatus of claim 1, further comprising a first valve means configured to allow unidirectional flow from said space to said inlet.

9. The dispensing apparatus of claim 8, further comprising a second valve means configured to allow unidirectional flow from said supply container to said space.

10. The dispensing apparatus of claim 9, wherein each of said first valve means and said second valve means is a flapper valve.

* * * * *